US010660811B2

(12) United States Patent
Dougherty

(10) Patent No.: US 10,660,811 B2
(45) Date of Patent: May 26, 2020

(54) ASSISTIVE TOILETING AND WEIGHING DEVICE

(71) Applicant: Kimberly Ann Dougherty, Worth, IL (US)

(72) Inventor: Kimberly Ann Dougherty, Worth, IL (US)

( * ) Notice: Subject to any disclaimer, the term of this patent is extended or adjusted under 35 U.S.C. 154(b) by 45 days.

(21) Appl. No.: 16/041,733

(22) Filed: Jul. 20, 2018

(65) Prior Publication Data

US 2020/0022858 A1 Jan. 23, 2020

Related U.S. Application Data

(60) Provisional application No. 62/534,980, filed on Jul. 20, 2017.

(51) Int. Cl.

| | |
|---|---|
| ***A61G 7/10*** | (2006.01) |
| ***A61G 5/14*** | (2006.01) |
| ***A47K 17/02*** | (2006.01) |

(52) U.S. Cl.

CPC ..... *A61G 7/1007* (2013.01); *A61G 5/14* (2013.01); *A47K 17/02* (2013.01); *A61G 7/1019* (2013.01); *A61G 2200/34* (2013.01)

(58) Field of Classification Search

CPC .. A61G 7/1007; A61G 7/1036; A61G 7/1019; A61G 7/1003; A61G 7/1046; A61G 5/14; A47K 17/02

See application file for complete search history.

(56) References Cited

U.S. PATENT DOCUMENTS

| | | | | |
|---|---|---|---|---|
| 4,894,871 A * | 1/1990 | Schmerler | A47K 17/026 | 135/67 |
| 5,323,497 A * | 6/1994 | Lih | A47K 13/10 | 297/DIG. 10 |
| 5,926,859 A * | 7/1999 | Kimura | A47K 17/02 | 4/254 |
| 6,247,718 B1 * | 6/2001 | Gobbers | A61G 5/104 | 180/65.1 |
| 6,643,869 B1 * | 11/2003 | Sloan, Jr. | A61G 7/10 | 280/304.1 |
| 8,528,127 B1 * | 9/2013 | Gabaldon | A61G 7/1007 | 4/480 |

* cited by examiner

*Primary Examiner* — Janie M Loeppke

(57) ABSTRACT

An assistive toileting apparatus that is operable by a caretaker, allowing an individual to transition more readily from a wheelchair to a commode. A horizontal platform supports a first vertical tilt platform and a second vertical tilt platform and is slidably engaged with a frame. The first vertical tilt platform supports, secures, and tilts the wheelchair to assist the individual into a standing position. The horizontal platform can then be slid from the frame, such that first vertical tilt platform is displaced and the second vertical tilt platform is positioned behind the individual. The individual can then sit down on a commode seat provided by the second vertical tilt platform. Once finished, the commode seat can be tilted upward to assist the individual into the standing position. A control system allows the caregiver to operate the first vertical tilt platform and the second vertical tilt platform while assisting the individual.

20 Claims, 14 Drawing Sheets

ASSISTIVE TOILETING AND WEIGHING DEVICE

The current application claims a priority to the U.S. Provisional Patent application Ser. No. 62/534,980 filed on Jul. 20, 2017.

FIELD OF THE INVENTION

The present invention relates generally to assistive toileting devices. More specifically, the present invention is an assistive toileting apparatus that is operable by a caretaker or extraneous second set of hands, allowing an infirm individual to transition more readily from a wheelchair to a commode and back to the wheelchair.

BACKGROUND OF THE INVENTION

Presently the act of assisting an infirm individual or otherwise wheelchair occupant into an upright position to maneuver them to a toilet or commode, has had to be conducted through rudimentary mechanical systems or by hand not once, but twice to remove them from the wheelchair, and from the seat of the commode. Whereupon the caretaker will physically clasp or hug the wheelchair occupant, and lift them up into an upright standing position. The action of which can be physically draining for caretakers, nurses and other attendants in service to nursing homes, hospitals, or other locales with a large populace of wheelchair occupant individuals that may be capable of standing upright once already standing, but lack the means or physical strength to surmount gravity and attain an upright standing position themselves. Other rudimentary mechanical augmented means have been proposed that often require the infirm individual to pivot primarily at the hips to get out of their wheelchair or off of the commode. This can present a large deal of duress to the infirm individual as they may have deteriorated health and joints that can prove painful if pushed to stress. The present invention would seek to remedy this by providing an apparatus that mechanically or pneumatically assists the individual in standing upright from a wheelchair by raising a first vertical tilt platform upward and forward 45 degrees, and cycling the seat variant to that of a commode or other sitting amenity that the wheelchair occupant individual desires to use through a horizontal sliding action, where the commode seat may already be raised and lowered slowly through similar mechanical or pneumatic means to a sitting position. Upon conclusion of business, the apparatus again would aid the infirm individual with standing upright and tilting forward 45 degrees to aid the infirm individual into an upright position, and the seat variant may be cycled back to the wheelchair by sliding the horizontal platform behind the infirm individual. Thus, the apparatus would circumvent the need for manually assisting the infirm with standing upright and may additionally utilize optional sensors to confirm safety compliance and mitigate dangers to the individual such as strapping down the wheelchair to the first vertical platform prior to operation of the apparatus. The present invention further requires no axial pivoting of the infirm individual by actuating in a linear fashion to achieve an upright position unlike prior attempts at mechanically assistive systems and additionally permitting the horizontal translation of the horizontal platform.

DETAIL DESCRIPTIONS OF THE INVENTION

Figure 1:
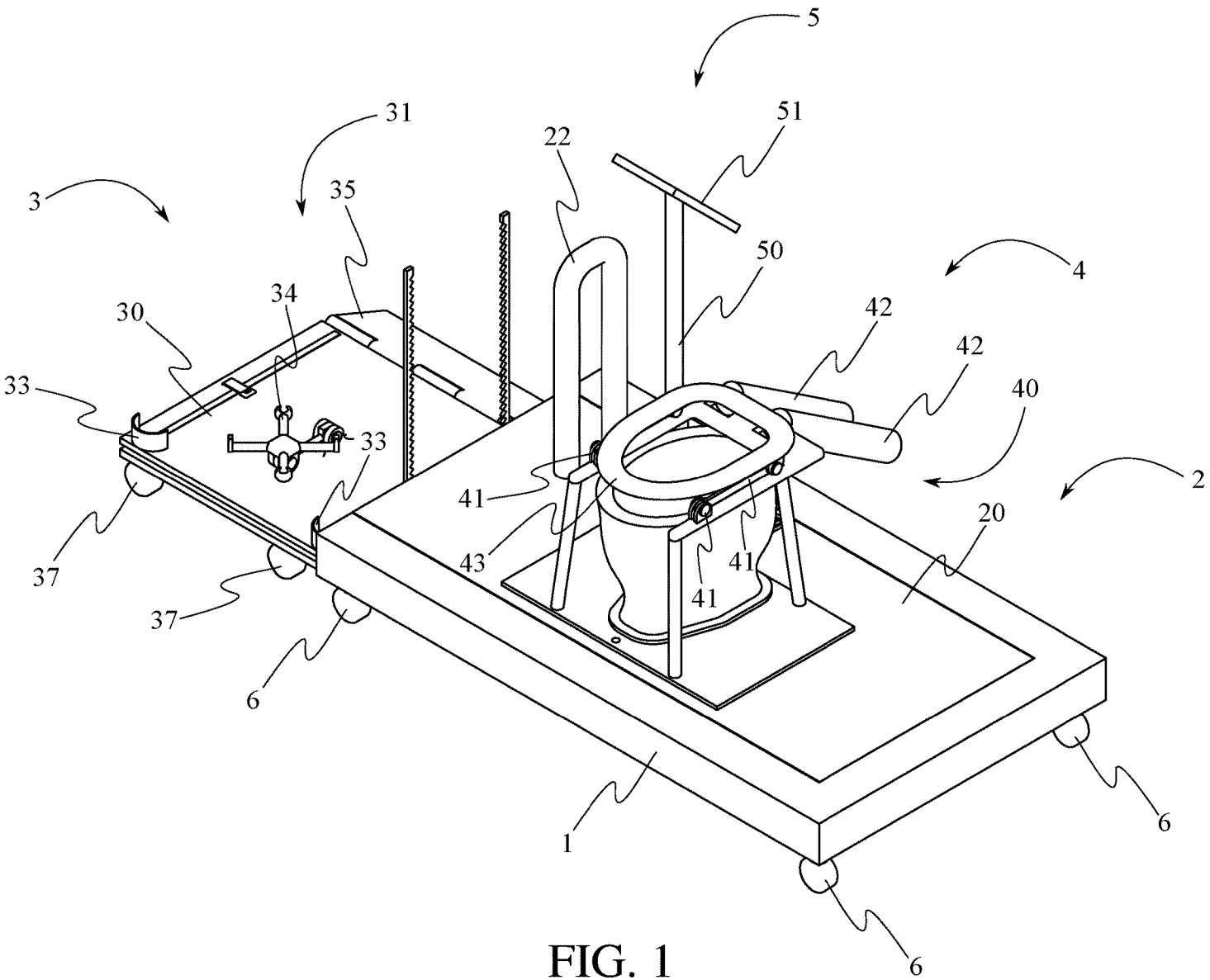
FIG. 1 is a front perspective view of an assistive toileting apparatus of the present invention.

All illustrations of the drawings are for the purpose of describing selected versions of the present invention and are not intended to limit the scope of the present invention.

The present invention is an assistive toileting apparatus that is operable by a caretaker or extraneous second set of hands, allowing an infirm individual to transition more readily from a wheelchair to a commode and back to the wheelchair. In order to assist the individual from the wheelchair to the commode and back and in reference to FIG. 1-2, the present invention comprises a frame 1, a horizontal platform 2, a first vertical tilt platform 3, a second vertical tilt platform 4, and a control system 5. The first vertical tilt platform 3 aids in positioning the individual into an upright position in front of the horizontal platform 2, wherein the horizontal platform 2 is capable of sliding and translating linearly in the horizontal direction within the frame 1.

Figure 3:
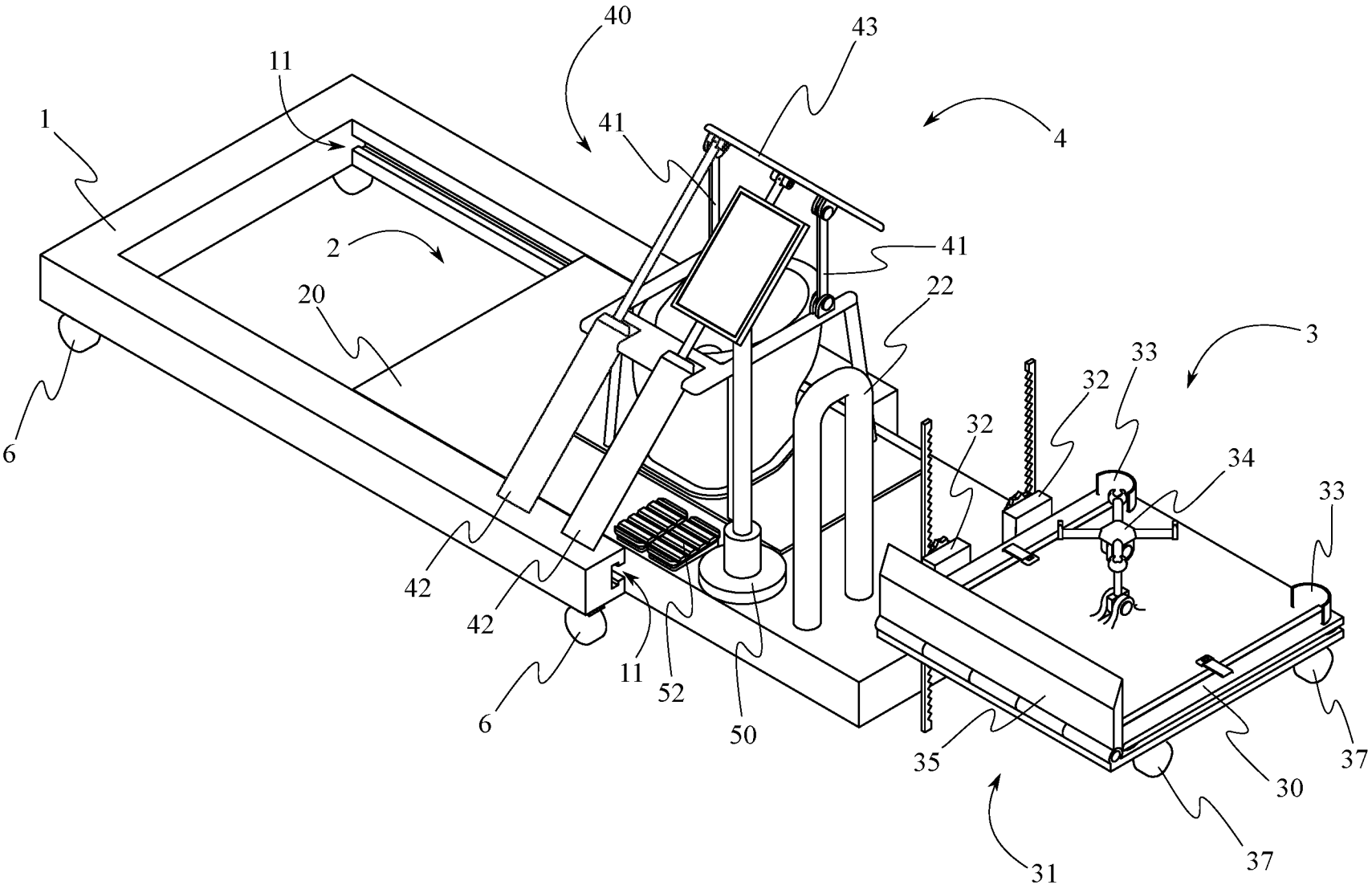
FIG. 3 is another rear perspective view of the assistive toileting apparatus of the present invention.
Figure 4:
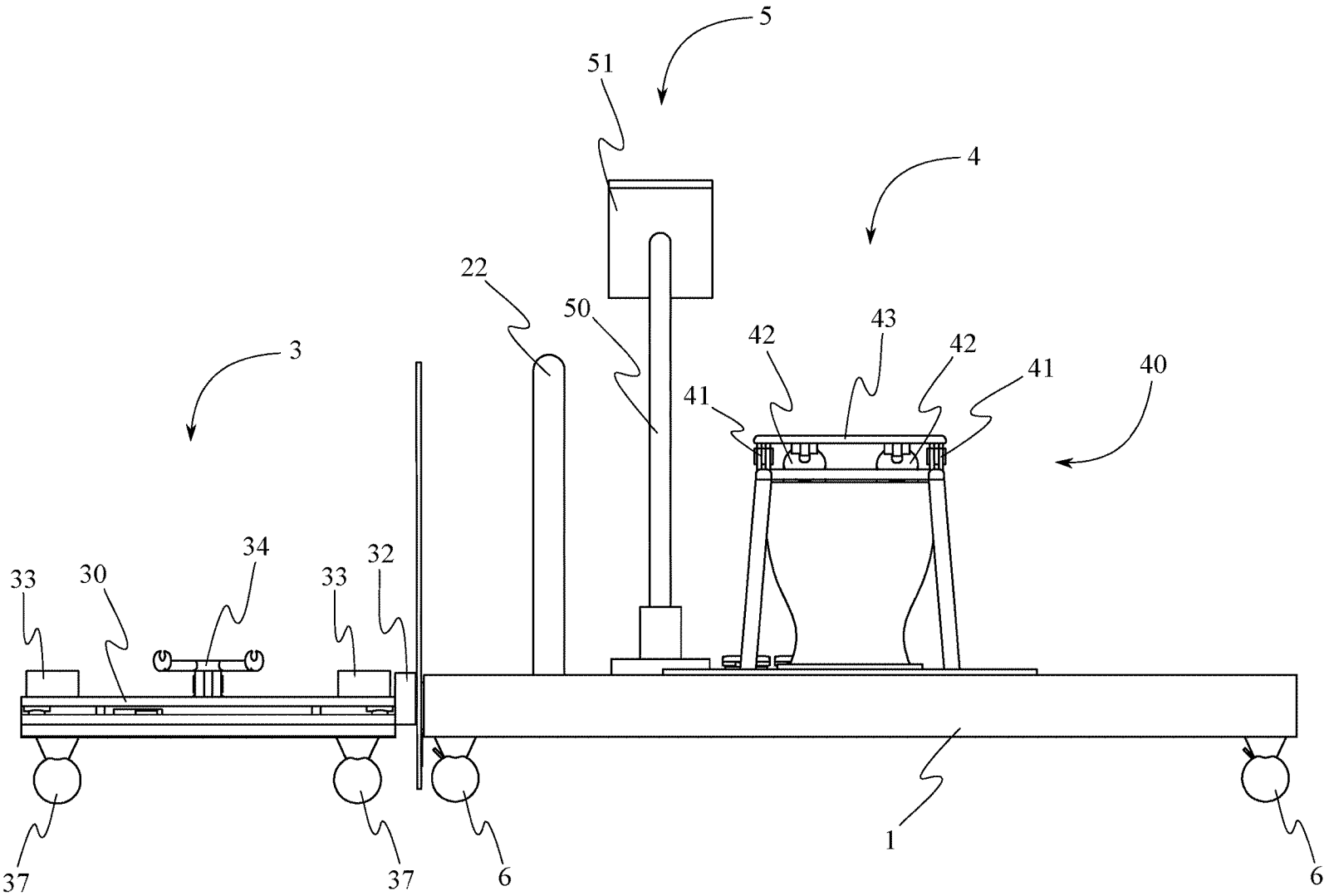
FIG. 4 is a front view of the assistive toileting apparatus of the present invention.
Figure 5:
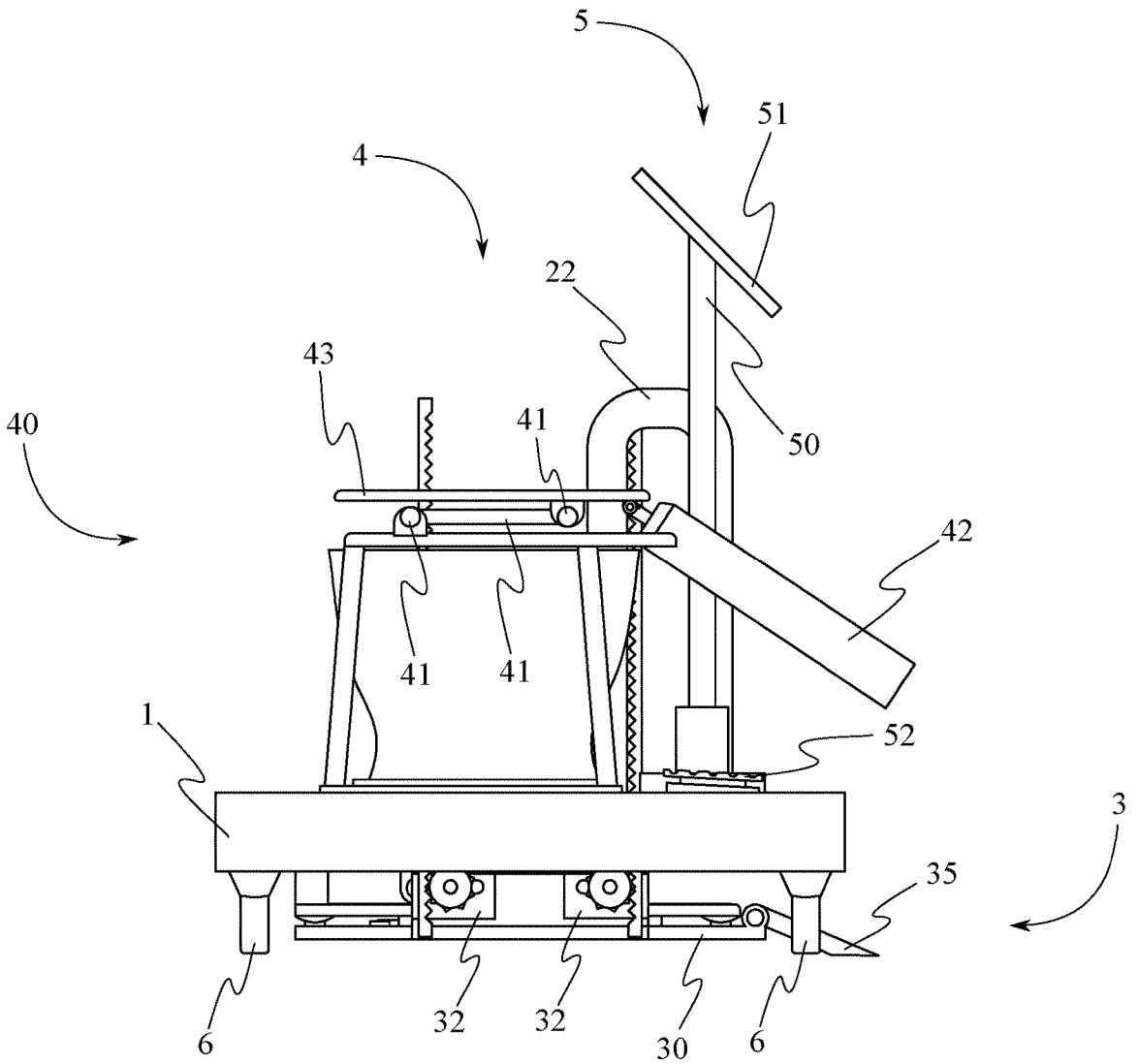
FIG. 5 is a right view of the assistive toileting apparatus of the present invention.
Figure 6:
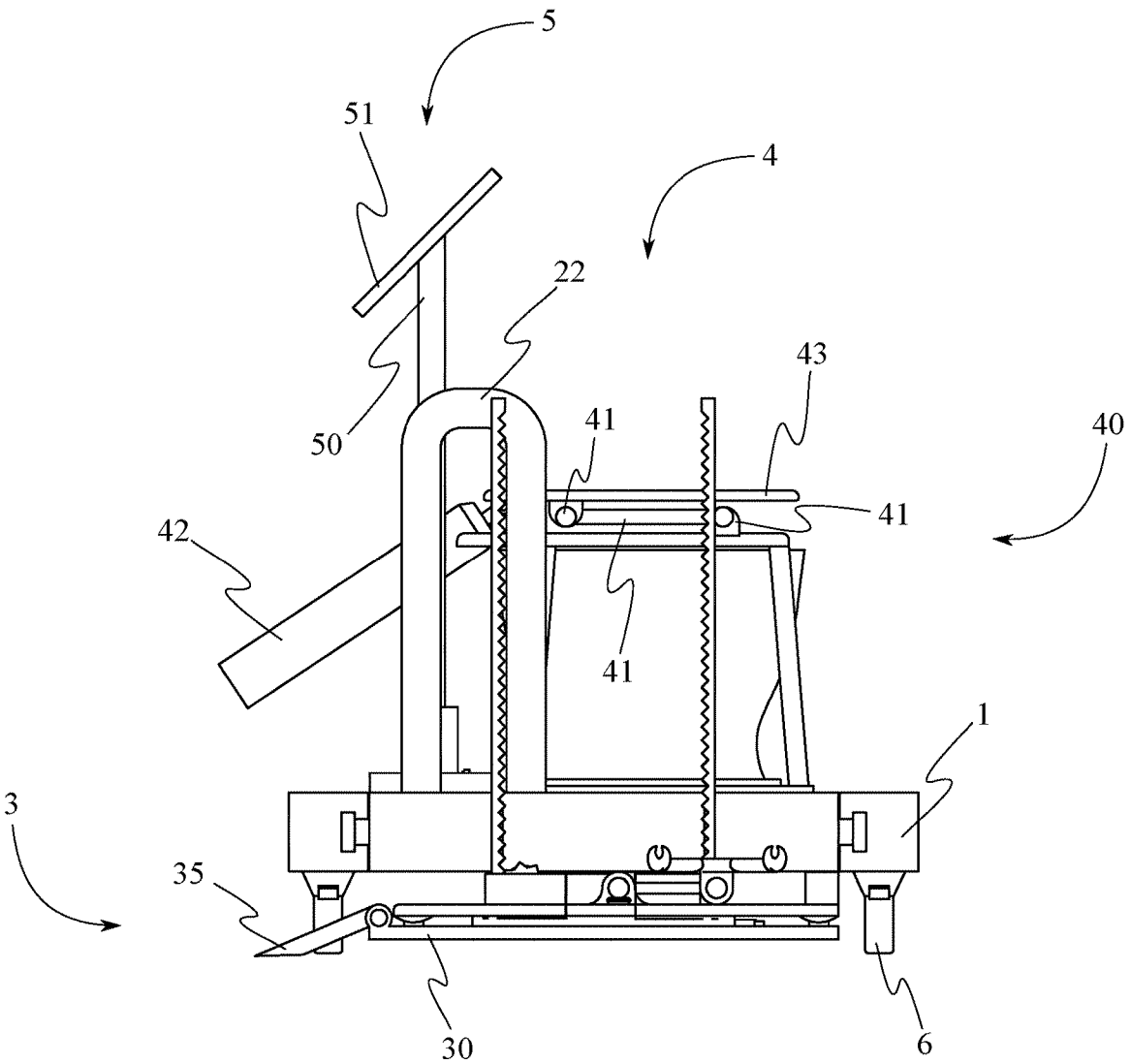
FIG. 6 is a left view of the assistive toileting apparatus of the present invention.

The first vertical tilt frame 1 provides a means for supporting and securing the wheelchair, wherein the wheelchair can be tilted at an angle to assist the individual in achieving a standing position. Meanwhile, the second vertical tilt platform 4 is mounted onto the horizontal platform 2 and provides the necessary toileting components. Once the individual is in the standing position, the horizontal platform 2 may be pulled outwards from the frame 1 as depicted in FIG. 3, such that the second vertical tilt platform 4 is positioned behind the individual. Similar to the first vertical tilt platform 3, the second vertical tilt platform 4 provides a means to assist the individual in sitting down and standing back up. Once the individual has relieved themselves and is again in the standing position, the horizontal platform 2 can be retracted back into the frame 1, such that the first vertical lift platform is re-positioned behind the individual. The first vertical tilt platform 3 is then used to assist the individual in returning to a seated position within the wheelchair.

Figure 11:
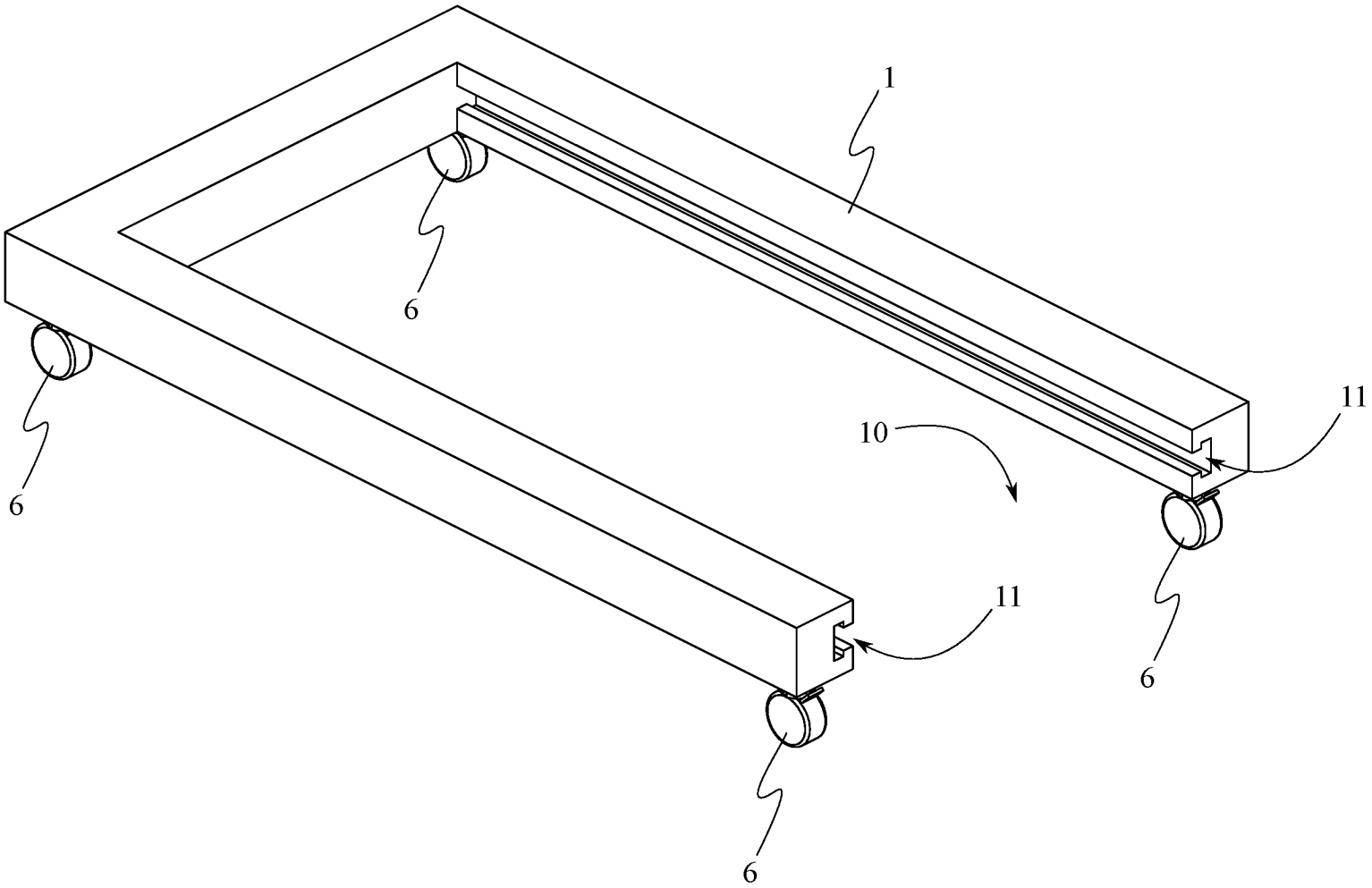
FIG. 11 is a perspective view of a frame and a plurality of frame wheels of the assistive toileting apparatus of the present invention.

In reference to FIG. 11, the frame 1 is a preferably rectilinear body that has an open end 10 and a plurality of rail cavities 11. In some embodiments, the frame 1 may be formed by two parallel beams that are terminally connected by a perpendicular beam, wherein the open end 10 is positioned opposite the perpendicular beam along the two parallel beams. In such embodiments, the frame 1 is formed into a U-shaped rectilinear beam that suits the longitudinal and lateral dimensions of the horizontal platform 2. The frame 1 operates as the basal structure of the assistive toileting apparatus that supports the horizontal platform 2 and subsequently the first vertical tilt platform 3 and the second vertical tilt platform 4. The horizontal platform 2 is slidably engaged with the frame 1, such that the horizontal platform 2 may be extended away from the frame 1 though the open end 10 as depicted through FIG. 2-3.

The frame 1 delineates a frame cavity in which the horizontal platform 2 is stored in a retracted position. The frame cavity is positioned adjacent to the open end 10, such that the horizontal platform 2 can be configured into an extended position by sliding the horizontal platform 2 along the frame 1 and out through the open end 10. Boring into the frame 1 along the longitudinal interior facing surfaces of the frame 1 is the plurality of rail cavities 11. Each of the plurality of rail cavities 11 extends from the open end 10 of the frame 1 to the closed end as depicted in FIG. 11, providing an integrated track along the frame 1. The horizontal platform 2 is slotted into each of the plurality of rail cavities 11, wherein the plurality of rail cavities 11 allows for horizontal movement of the horizontal platform 2, while restricting vertical movement of the horizontal platform 2. The plurality of rail cavities 11 may possess a rectilinear geometry, a curvilinear geometry, or any other geometry best suited for retaining the horizontal platform 2 and facilitating linear movement of the horizontal platform 2 along the frame 1.

A rail aperture is provided for each of the plurality of rail cavities 11, wherein the rail aperture is positioned adjacent to a corresponding rail cavity from the plurality of rail cavities 11. In this way, the horizontal platform 2 can be configured into the extended position by sliding the horizontal platform 2 along the frame 1 and out through the rail aperture. The rail aperture corresponding to each of the plurality of rail cavities 11 may optionally possess a closure that may be latched closed or secured to restrict the movement of the horizontal platform 2 and prevent the horizontal platform 2 from overextending and disengaging from the plurality of rail cavities 11.

Figure 10:
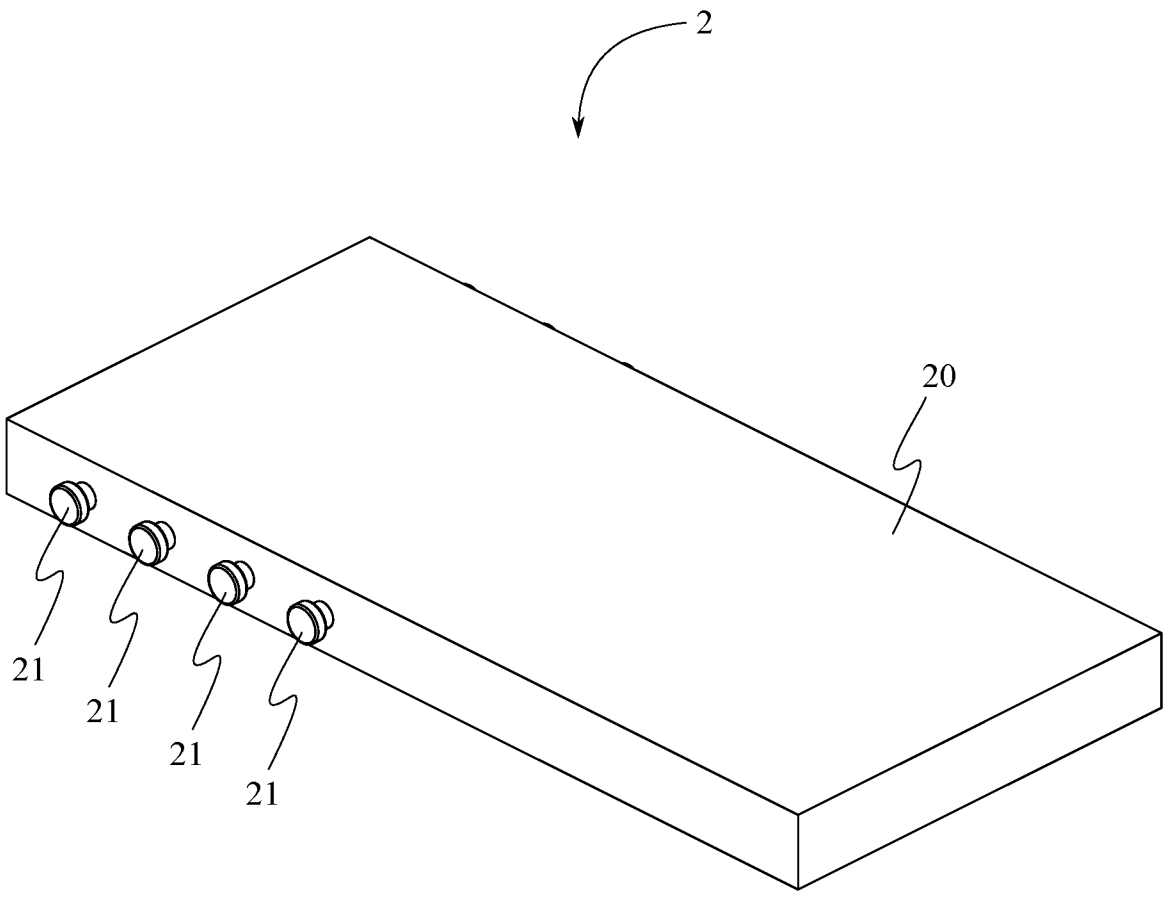
FIG. 10 is a perspective view of a horizontal platform of the assistive toileting apparatus of the present invention.

In reference to FIG. 10, the horizontal platform 2 comprises a platform base 20 and a plurality of rail casters 21. The platform base 20 is a generally rectilinear body of a height near or equivalent to the frame 1 and preferably possessing a longitudinal and lateral dimension equivalent to the frame cavity. The platform base 20 forms the basal structure that supports the first vertical tilt platform 3 and the second vertical tilt platform 4 as depicted in FIG. 4-7. The plurality of rail casters 21 is laterally connected to the platform base 20, wherein the plurality of rail casters 21 is distributed along the platform base 20 as depicted in FIG. 10. Each of the plurality of rail casters 21 is aligned with and positioned into one of the plurality of rail cavities 11, wherein each of the plurality of rail cavities 11 serves as a track that guides one or more of the plurality of rail casters 21. The plurality of rail casters 21 may traverse back and forth along the frame 1, within the plurality of rail cavities 11, thus allowing the platform base 20 to translate along the horizontal dimension.

In some embodiments, the rail aperture may be coincident in profile to the corresponding rail cavity. In this way, the rail aperture corresponding to each of the plurality of rail cavities 11 allows for the insertion or removal of the plurality of casters to or from the plurality of rail cavities 11. In other embodiments, the rail aperture may have a smaller profile than the corresponding rail cavity. In this way, the rail aperture corresponding to each of the plurality of rail cavities 11 prevents the platform base 20 from overextending and the plurality of casters from disengaging from the plurality of rail cavities 11.

In the preferred embodiment, the frame 1 is U-shaped and the plurality of rail cavities 11 is two cavities as depicted in FIG. 11, wherein the two cavities extend along the two parallel beams of the frame 1. Meanwhile, the plurality of casters is eight casters located on the longitudinal surfaces of the platform base 20. Four casters are positioned on each side of the platform base 20, wherein each set of four casters is arranged in a linear equidistant configuration along the half of the platform base 20 nearest the closed end of the frame 1. Each set of four casters is positioned within opposing cavities, permitting the platform base 20 to translate linearly across the horizontal dimension.

Preferably located furthest from the closed end of the frame 1 and adjacent to the horizontal platform 2 is the first vertical tilt platform 3. More specifically, the first vertical tilt platform 3 is terminally connected to the platform base 20, adjacent to the open end 10 of the frame 1. The first vertical tilt platform 3 allows for the wheelchair to be secured and subsequently lifted and/or tilted forward to aid in unseating the individual from the wheelchair. In reference to FIG. 1-3, the first vertical tilt platform 3 comprises a wheelchair support platform 30, a ramp 35, a plurality of wheel stops 33, a wheelchair clasp system 34, and a plurality of platform actuators 32. The wheelchair support platform 30 is a rectilinear platform onto which the wheelchair may be positioned and secured in order to assist the individual in achieving the standing position. The wheelchair support platform 30 is configured to incline at a first tilt angle 36 in relation to the platform base 20 in order to assist the individual in transferring in and out of the wheelchair.

Each of the plurality of platform actuators 32 is operably coupled to the wheelchair support platform 30, wherein the plurality of platform actuators 32 is configured to incline the wheelchair support platform 30 at the first tilt angle 36. The plurality of platform actuators 32 may include linear actuators, rotational actuators, or a combination thereof. In some embodiments, each of the plurality of platform actuators 32 may be a linear actuator that engages with the bottom surface of the wheelchair support platform 30, wherein the plurality of platform actuators 32 is distributed about the four corners of the wheelchair support platform 30. The plurality of platform actuators 32 in this embodiment would operate preferably independently or in sets of two to lift and pitch the wheelchair support platform 30 at the first tilt angle 36 to aid in unseating the individual in the wheelchair.

In other embodiments, the plurality of platform actuators 32 may drive one or more pinion gears adjacently connected to the wheelchair support platform 30 and engaged with one or more racks. The one or more racks is positioned in between the platform base 20 and the wheelchair support platform 30, wherein the one or more racks connects the wheelchair support platform 30 to the platform base 20. The plurality of platform actuators 32 includes one or more rotational actuators, wherein the one or more rotational actuators is coupled to the one or more pinion gears. The one or more rotational actuators rotates the one or more pinion gears, wherein the one or more pinion gears is ratcheted along the one or more racks by engaging the teeth of each of the pinion gears to the cavities of each of the racks. As the one or more pinion gears traverses along the one or more racks, the wheelchair support platform 30 is elevated and tilted to the first tilt angle 36.

In yet other embodiments, the plurality of platform actuators 32 may be coupled to the wheelchair support platform 30 through a plurality of platform linkages. The plurality of platform actuators 32 acts on the plurality of platform linkages, which then translate the motion of the plurality of platform actuators 32 to movement of the wheelchair support platform 30. For example, the plurality of platform linkages may form one or more scissor mechanisms, wherein the plurality of platform actuators 32 applies pressure to the one or more of the plurality of platform linkages in order to expand and contract the plurality of platform linkages. In other examples, the plurality of platform linkages may include pistons that are used to translate motion to the wheelchair support platform 30.

The specific value of the first tilt angle 36 may vary depending on the embodiment of the present invention and/or unique parameters of the individual. In some embodiments, the value of the first tilt angle 36 may be monitored and controlled by the caregiver or the individual via the control system 5. In other embodiments, the value of the first tilt angle 36 may be pre-defined and constant. In yet other embodiments, the value of the first tilt angle 36 may be variable from one person to another, wherein the unique parameters of the individual, such as height and weight, are entered into the control system 5 prior to manipulating the position of the wheelchair support platform 30.

Figure 2:
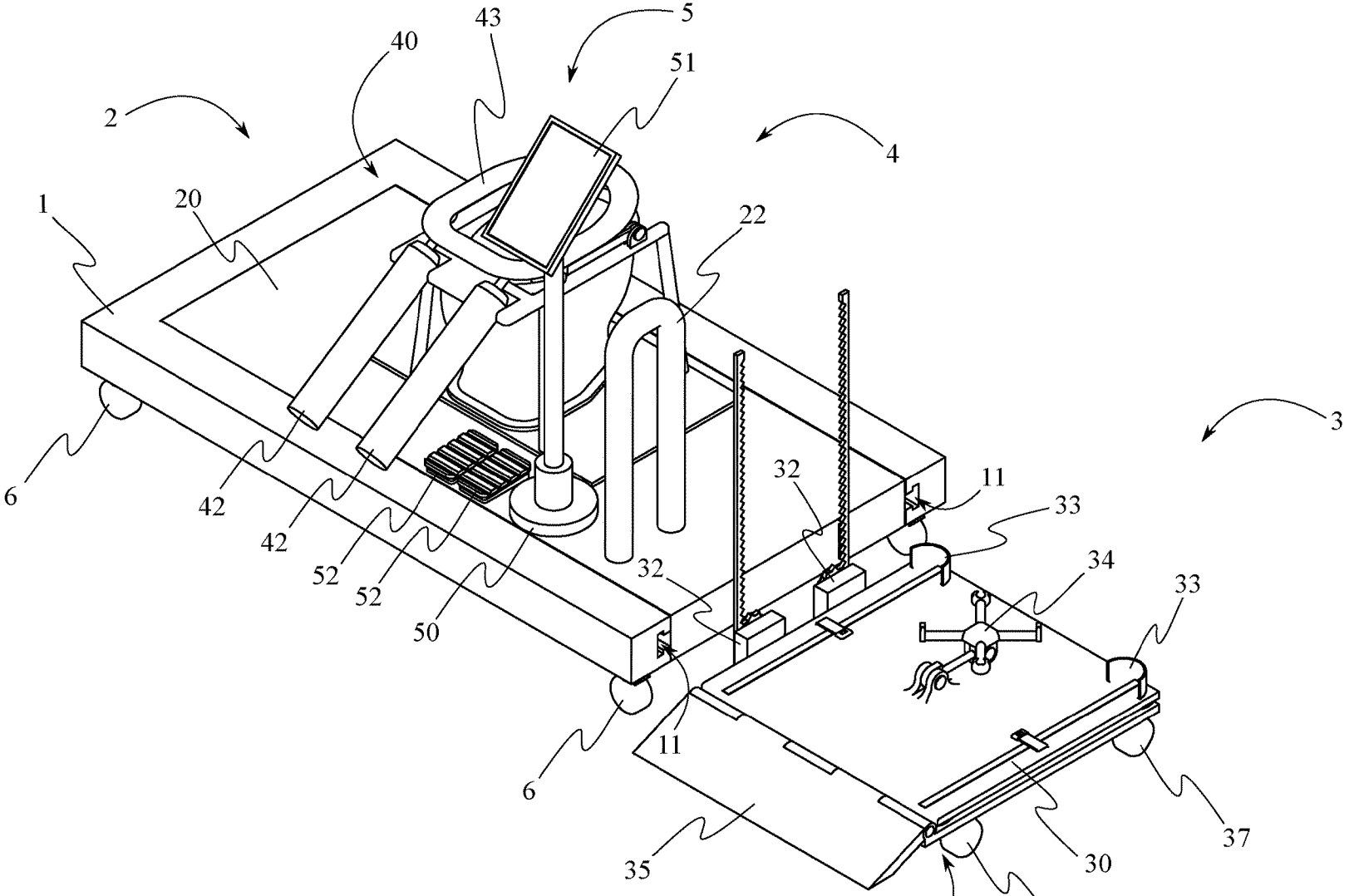
FIG. 2 is a rear perspective view of the assistive toileting apparatus of the present invention.

In reference to FIG. 2-3, the ramp 35 is hingedly connected to the wheelchair support platform 30, wherein the ramp 35 facilitates loading the wheelchair onto the wheelchair support platform 30. The wheelchair support platform 30 comprises a loading end 31 about which the ramp 35 is hingedly connected to the wheelchair support platform 30. The loading end 31 is an edge of the wheelchair support platform 30 that does not have a lateral wall, or other obstructions, that may prevent the wheelchair from being rolled onto the wheelchair support platform 30. Moreover, the ramp 35 is able to act as a barrier to prevent the wheelchair from rolling off of the wheelchair support platform 30, once the wheelchair has been loaded onto the wheelchair support platform 30. To load the wheelchair onto the wheelchair support platform 30, the ramp 35 is angled downwards to create an elevated path from the ground to the wheelchair support platform 30. Once the wheelchair is loaded, the ramp 35 can be angled upwards, providing a barrier and closed edge for the wheelchair support platform 30.

Preferably, the ramp 35 is located about the rear edge of the wheelchair support platform 30. However, the ramp 35 may also be located on the front or side of the wheelchair support platform 30 in some embodiments. The wheelchair support platform 30 comprises a plurality of platform hinge joints that complement a plurality of ramp 35 hinge joints of the ramp 35, wherein the plurality of platform hinge joints and the plurality of ramp 35 hinge joints are linearly distributed in an alternating manner. Furthermore, the plurality of platform hinge joints is concentric with the plurality of ramp 35 hinge joints, wherein a ramp 35 axle traverses through both the plurality of platform hinge joints and the plurality of ramp 35 hinge joints to secure the ramp 35 to the wheelchair support platform 30. In some embodiments, the ramp 35 may be manually rotated up and down. In other embodiments, the rotation of the ramp 35 may be automated through the use of a motor, or similar device, wherein the motor may be actuated through the control system 5. In yet other embodiments, the ramp 35 may be fixed in place and unable to pivot about the wheelchair support platform 30.

Alternatively, the first vertical tilt platform 3 may be located above the platform base 20 and positioned adjacent to the second vertical tilt platform 4. Meanwhile, the ramp 35 would still be located at the rear edge of the wheelchair support platform 30 to allow the wheelchair to dock but the platform base 20 would possess a tiered surface where the space underlying the first vertical tilt platform 3 must be lower to permit the wheelchair adequate docking clearance with the ground and optionally a hinged frame end coincident and equivalent to the longitudinal length of the ramp 35.

The plurality of wheel stops 33 is adjacently connected to the top of the wheelchair support platform 30, wherein the plurality of wheel stops 33 provides a means to prevent the wheelchair from rolling off of the wheelchair support platform 30 upon loading the wheelchair. In reference to FIG. 8, the plurality of wheel stops 33 is positioned on the wheelchair support platform 30 opposite the loading end 31. In this way, the wheelchair is pushed up the ramp 35 and across the wheelchair support platform 30, wherein the wheels of the wheelchair then engage with the plurality of wheel stops 33. Preferably, the plurality of wheel stops 33 is two, wherein the two stops are configured to engage with the front wheels of the wheelchair. However, it is possible for additional stops to be used, or for the plurality of wheel stops 33 to be designed to engage with the rear wheels of the wheelchair. In some embodiments, each of the plurality of wheel stops 33 forms a curvilinear barrier that restricts the motion of the wheelchair when being boarded onto the wheelchair support platform 30. In this way, each of the plurality of wheel stops 33 forms an opening to receive one of the wheels of the wheelchair, while each of the plurality of wheel stops 33 curves around the corresponding wheel to prevent the wheels from moving side to side.

The first vertical tilt platform 3 may further comprise a plurality of indicium. The plurality of indicium would provide a visual guide along which to roll the wheelchair and align the wheels of the wheelchair with the plurality of wheel stops 33. Furthermore, the plurality of indicium help ensure that the wheelchair is properly oriented in order to be secured to the wheelchair support platform 30 by the wheelchair clasp system 34. The plurality of indicium is disposed on the top of the wheelchair support platform 30, such that the plurality of indicium is readily visible to the caregiver. In some embodiments, each of the plurality of indicium may be a solid line that extends from one of the plurality of wheel stops 33 to the loading end 31 of the wheelchair support platform 30. In other embodiments, each of the plurality of indicium may be a dashed line, dotted line, or other visual cue.

Figure 8:
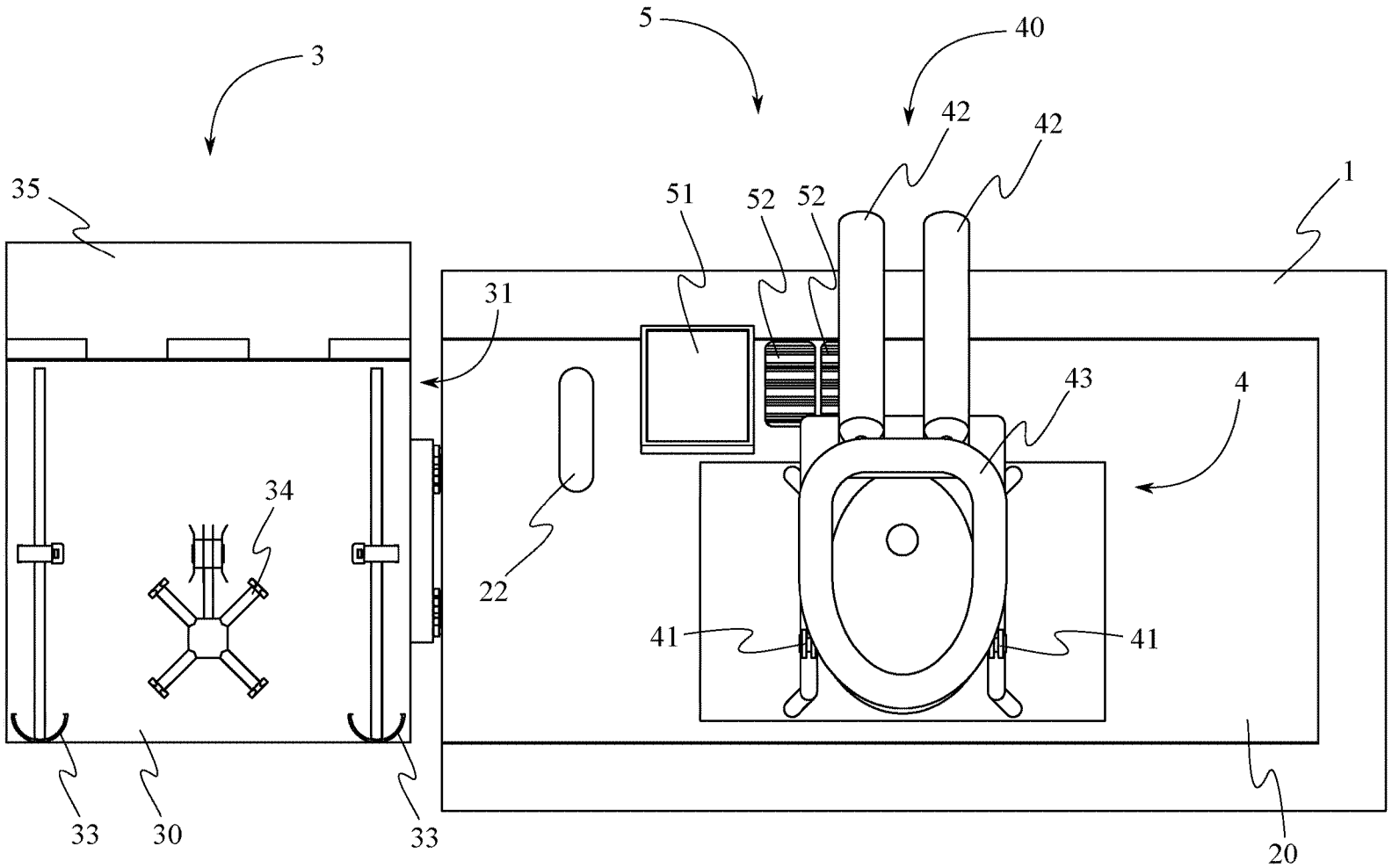
FIG. 8 is a top view of the assistive toileting apparatus of the present invention.

In reference to FIG. 8, located at the center of the wheelchair support platform 30, on the top surface, is the wheelchair clasp system 34 that affixes to the underside crossbeam present of the wheelchair. The wheelchair clasp system 34 is pivotally connected to the wheelchair support platform 30, such that the wheelchair clasp system 34 may be retracted to load and unload the wheelchair and extended to secure the wheelchair to the wheelchair support platform 30. The wheelchair clasp system 34 would preferably utilize a wheelchair linkage that enables the wheelchair clasp system 34 to collapse and erect either through spring loaded force, manual manipulation, actuators, and other means of activation that result in the plurality of grips aligning with the crossbeam of the wheelchair. The erection of the wheelchair clasp system 34 may be actuated manually or automatically through the use of sensors and/or mechanical systems, such as a spring-loaded mechanism integrated with the plurality of wheel stops 33 and designed to engage with the wheels of the wheelchair. Furthermore, one or more tension, conduit, visual, pressure, or other type sensor may be utilized to detect whether the wheelchair has been satisfactorily affixed to the wheelchair clasp system 34.

Protruding from the center of the wheelchair support platform 30 and formed of at least one link that connects between the top surface of the wheelchair support platform 30 and the bottom of the wheelchair clasp system 34 is the wheelchair linkage. The wheelchair linkage would permit the wheelchair clasp system 34 to pivot up to 180 degrees about the top surface of the wheelchair support platform 30. In some embodiments of the present invention, the wheelchair clasp system 34 comprises a belt tube and a safety belt. The belt tube is pivotally connected to the wheelchair support platform 30 via the wheelchair linkage. The belt tube is a hollow casing that may be curved in order to partially fit around the underside crossbeam of the wheelchair. Furthermore, the belt tube may be an articulated tubing, such that the curvature may be readjusted to accommodate crossbeams of different size, shape, placement, etc. The safety belt traverses through the belt tube, wherein a buckle of the safety belt is positioned adjacent to the opening of the belt tube.

As the belt tube is pivoted upwards, towards the underside crossbeam, the buckle of the of the safety belt is simultaneously raised. When the belt tube is fully raised, the buckle is positioned above the underside crossbeam. The caregiver can then grasp the buckle and pull the safety belt downwards, towards the wheelchair support platform 30. The buckle may then be engaged with a receiver integrated into the wheelchair support platform 30 in order to secure the wheelchair to wheelchair support platform 30. In such an embodiment the wheelchair clasp system 34 may further include an alert system similar to that of a car seat, wherein an audible alarm will sound if the buckle is not engaged with the receiver as the caregiver attempts to tilt the wheelchair support platform 30.

In other embodiments, the wheelchair clasp system 34 is a preferably rectilinear body that comprises a plurality of protrusions. Each of the plurality of protrusions extends from the four corners of a base frame, wherein the plurality of protrusions aligns with the underside crossbeam of the wheelchair. Located at the distal end of each of the plurality of protrusions is a grip that may wrap, fasten, clasp, grip, or affix to the underside crossbeam of the wheelchair. Each of the plurality of protrusions may further include one or more sensors to confirm compliance regarding how secure the wheelchair is upon the wheelchair support platform 30. It may be appreciated that the wheelchair linkage may utilize a scissor linkage composed of a plurality of links, or other linkage systems to elevate the wheelchair clasp system 34 vertically.

The first vertical tilt platform 3 may further include a plurality of straps to further secure the wheelchair to the wheelchair support platform 30, wherein the plurality of straps is adjacently connected to the top of the wheelchair support platform 30. Each of the plurality of straps may be located at the midpoint of one of the plurality of indicium or elsewhere about the wheelchair support platform 30. The plurality of straps is configured to anchor the wheelchair to the wheelchair support platform 30 about the wheels of the wheelchair or a portion of the frame of the wheelchair. In one embodiment, the plurality of straps is four straps, wherein two straps are positioned on each side of the wheelchair support platform 30. Each of the plurality of straps has either a buckle or a receiver, wherein the two straps are able to engage with one another in order to be secured around the wheelchair. In other embodiments, the plurality of straps is two straps, wherein one strap is positioned on each side of the wheelchair support platform 30. Each strap has a buckle that is configured to engage with a receiver integrated into the wheelchair support platform 30 after being wrapped around a portion of the wheelchair.

Ultimately, the plurality of straps permits the wheelchair to be manually fastened to the wheelchair support platform 30 to prevent rolling when the wheelchair support platform 30 is tilted at the first tilt angle 36. Preferably, a sensor (or a plurality thereof) would be integrated into at least one of the plurality of straps to assess if the wheelchair has been satisfactorily affixed to the wheelchair support platform 30. In some embodiments the sensor may function similar to that of a car seatbelt. Further the status of the sensor (or plurality thereof) would indicate satisfaction as a status through the control system 5 and if met, allow operation of the plurality of platform actuators 32. If not satisfactory, the control system 5 would lock the operation of the plurality of platform actuators 32 until the wheelchair has been firmly secured and affixed to the wheelchair support platform 30 by the plurality of straps. Upon which the control system 5 may display the status of the present invention as operable or inoperable dependent on the satisfaction of securing the wheelchair clasp system 34 and the plurality of straps.

In some embodiments, the wheelchair support platform 30 is a weight scale. The weight scale would allow the weight of the individual to be measured by subtracting the weight of the wheelchair either autonomously once the individual is unseated, or by manually entering the wheelchair weight into the control system 5. In this instance, the weight of the wheelchair clasp system 34, the plurality of wheel stops 33, the ramp 35, the plurality of straps, the plurality of platform actuators 32, and any other components integrated with the wheelchair support platform 30 would be autonomously accounted for or tared.

In reference to FIG. 1-3, the second vertical tilt system forms the commode unit that is to be used by the individual. The second vertical tilt system comprises a commode seat 43, a seat lift-system 40, and a waste receptacle. The seat lift-system 40 is integrated into the top of the platform base 20, while the commode seat 43 is adjacently connected to the seat lift-system 40 opposite the platform base 20. The seat lift-system 40 is configured to incline the commode seat 43 at a second lift angle in relation to the platform base 20 in order to assist the individual in sitting down on the commode seat 43 and standing up from the commode seat 43.

In further reference to FIG. 1-3, in order to incline the commode seat 43, the seat-lift system comprises a plurality of seat actuators 42 and a plurality of seat linkages 41. The commode seat 43 is adjacently connected to the plurality of seat linkages 41, such that the plurality of seat linkages 41 is engaged between the top surface of the platform base 20 and the bottom surface of the commode seat 43. Meanwhile, the plurality of seat actuators 42 is operably coupled to the plurality of seat linkages 41 in order to incline the commode seat 43 at the second tilt angle 44. When acted upon by one or more of the plurality of actuators, the plurality of seat linkages 41 will preferably erect normal to the top surface of the platform base 20 and the commode seat 43 will tilt forward at the second tilt angle 44 to aid the individual into the standing position.

The plurality of seat actuators 42 may include linear actuators, rotational actuators, or a combination thereof. In some embodiments, each of the plurality of seat actuators 42 is a linear actuator, wherein the plurality of seat actuators 42 may be used to raise the back and/or front of the commode seat 43. In other embodiments, each of the plurality of seat actuators 42 is a rotational actuator that drives a gear or pinion along a track to provide a great output of force to tilt the commode seat 43 and aid the user to the standing position. Optionally, the plurality of seat actuators 42 may be complemented by a spring-loaded commode linkage from the plurality of seat linkages 41 that offsets the force necessary to lift the commode seat 43. The commode seat 43 may possess a plurality of protrusions that extend downwards and engage with the plurality of seat linkages 41. The commode seat 43 preferably assumes a conventional commode seat 43 and may have an open or closed front. The commode seat 43 in conjunction with the plurality of seat actuators 42 and the plurality of seat linkages 41 will be capable of both lifting and pitching forward at the second tilt angle 44 to aid the user in standing upright and ejecting from the commode seat 43 upon conclusion of their business.

The specific value of the second tilt angle 44 may vary depending on the embodiment of the present invention and/or unique parameters of the individual. In some embodiments, the value of the second tilt angle 44 may be monitored and controlled by the caregiver or the individual via the control system 5. In other embodiments, the value of the second tilt angle 44 may be pre-defined and constant. In yet other embodiments, the value of the second tilt angle 44 may be variable from one person to another, wherein the unique parameters of the individual, such as height and weight, are entered into the control system 5 prior to manipulating the position of the commode seat 43.

The waste receptacle is positioned below the commode seat 43 and provides a means for collecting the individual's waste. The waste receptacle may be attached to the seat lift-system 40 or the platform base 20. Preferably, the waste receptacle is maintained in a fixed position as the commode seat 43 is tilted, such that waste does not spill out of the waste receptacle. Furthermore, the waste receptacle is preferably removably attached to either the seat lift-system 40 or the platform base 20, such that the waste receptacle may be removed in order to empty the contents of the waste receptacle. In some embodiments, the waste receptacle may incorporate a flushing mechanism, such that the waste receptacle does not need to be removed in order to empty the contents of the waste receptacle.

Figure 7:
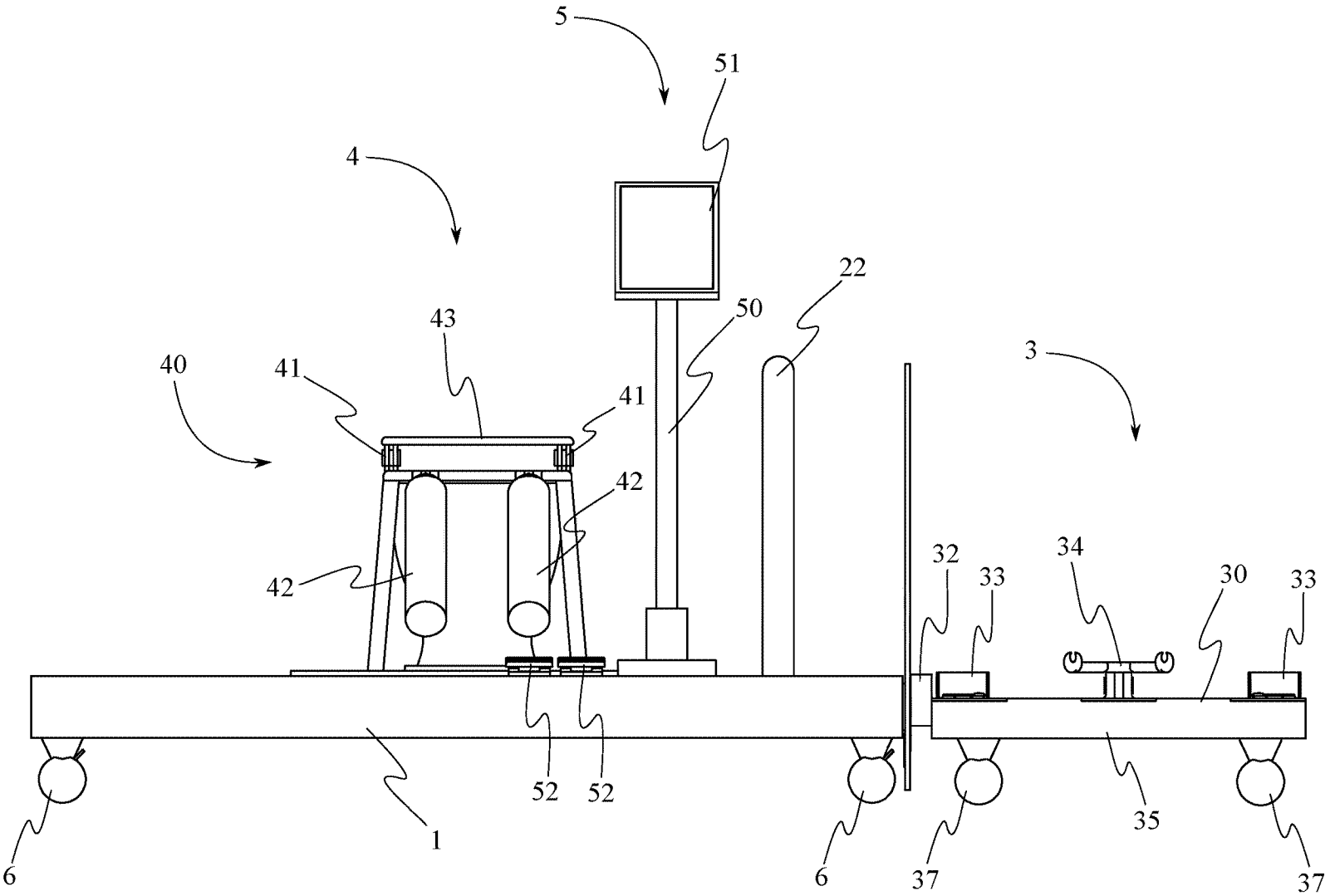
FIG. 7 is a rear view of the assistive toileting apparatus of the present invention.
Figure 12:
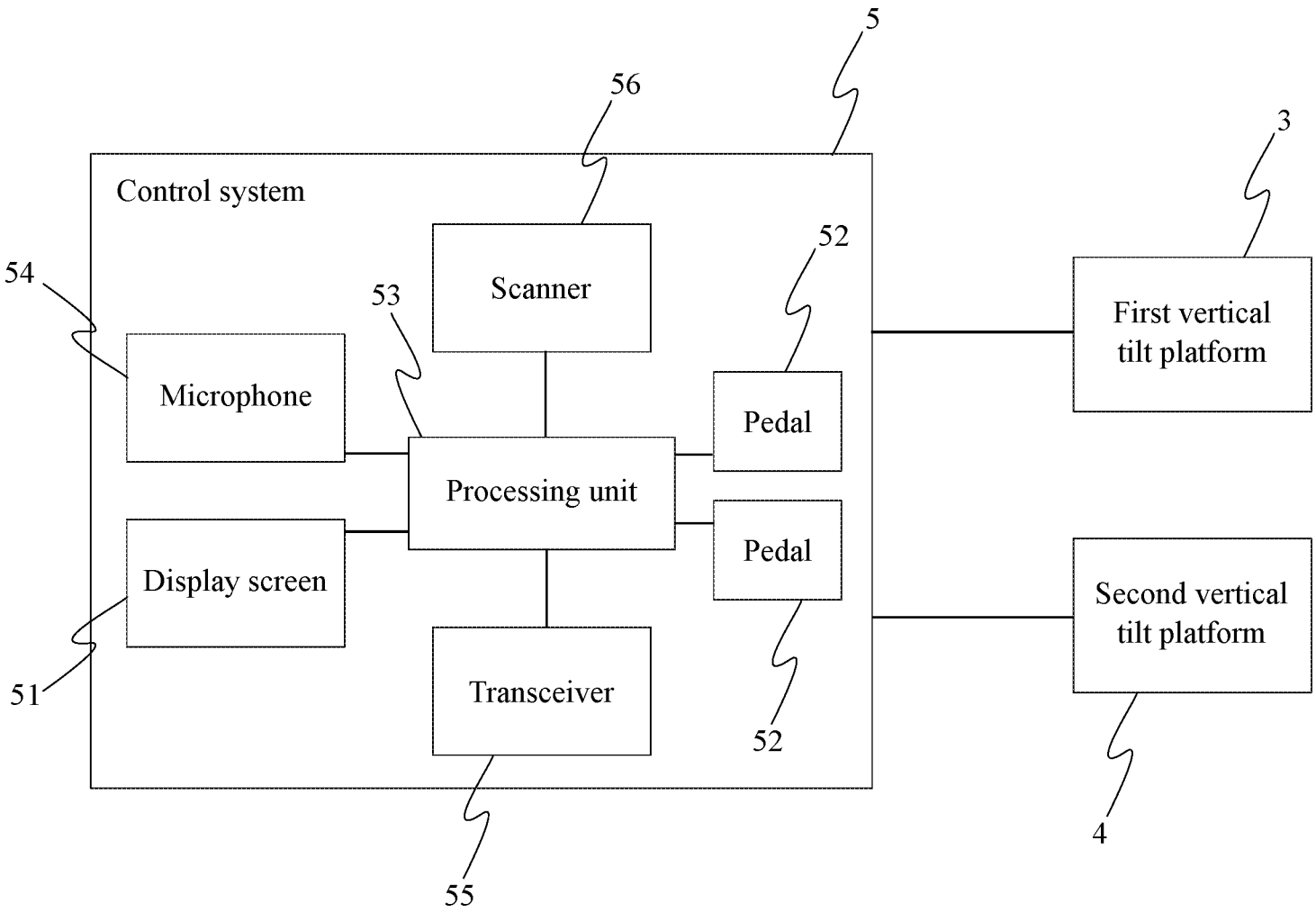
FIG. 12 is a schematic diagram showing electronic connections of a control system of the assistive toileting apparatus of the present invention.
Figure 13:
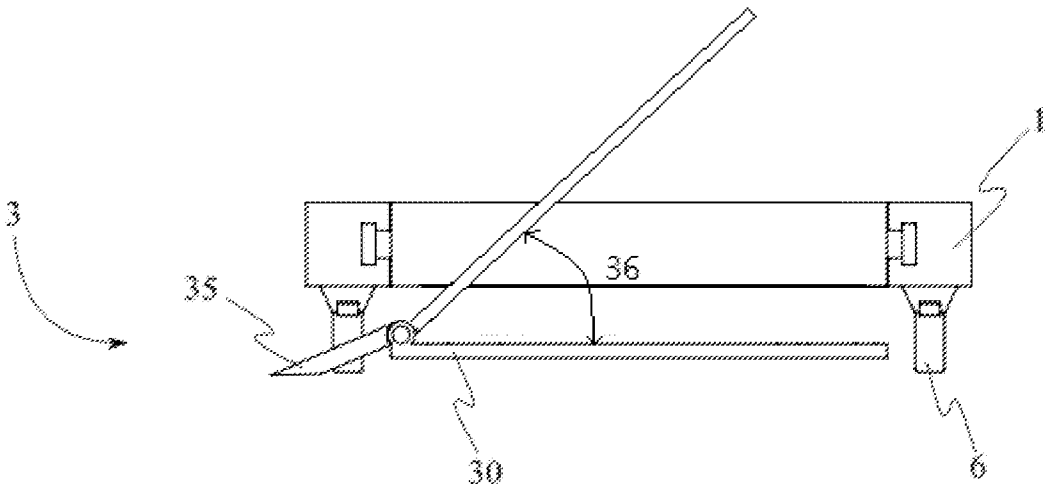
FIG. 13 is a schematic left view showing a wheelchair support platform inclining in relation to the frame of the present invention.
Figure 14:
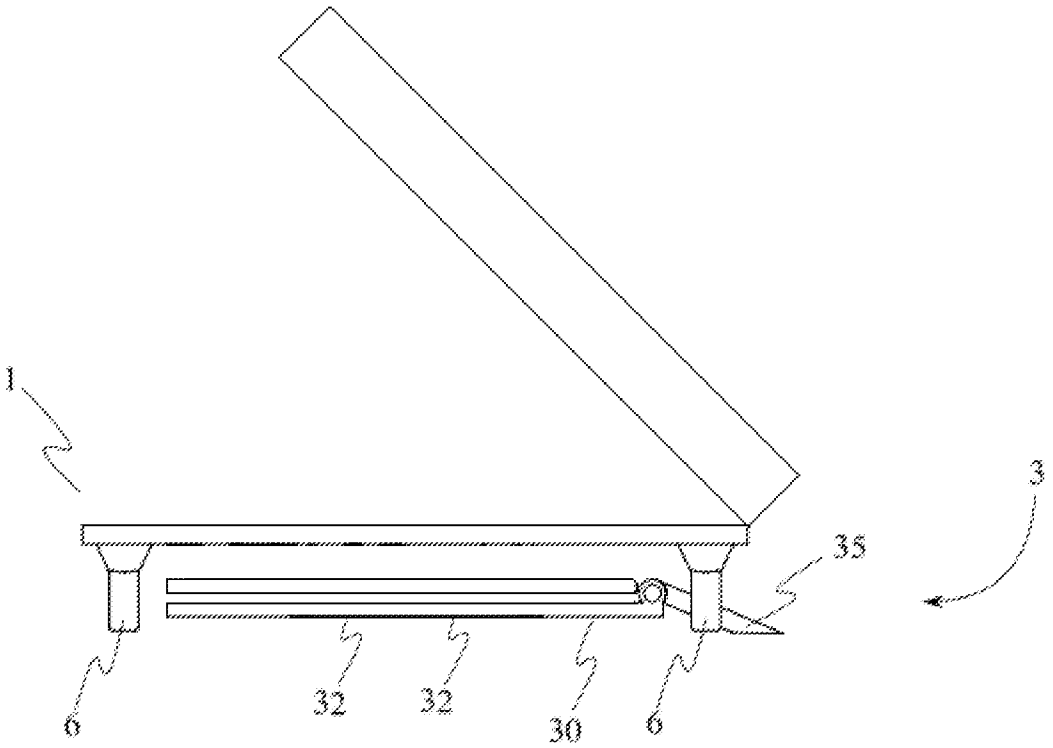
FIG. 14 is a schematic right view showing the frame inclining in relation to the wheelchair support platform of the present invention.

In reference to FIG. 12, the control system 5 is operably coupled to the first vertical tilt platform 3 and the second vertical tilt platform 4. Furthermore, the control system 5 enables the caretaker to monitor the operation of the assistive toileting apparatus, initiate commands into the assistive toileting apparatus, and ensure compliance is met by the wheelchair clasp system 34 and the plurality of straps to ensures the wheelchair will not roll forward upon activation and endanger the individual. The control system 5 may comprise a stand 50 and a display screen 51 as depicted in FIG. 7. The stand 50 is adjacently connected to the platform base 20, while the display screen 51 is terminally connected to the stand 50 opposite the platform base 20. The stand 50 rises up to an observable, operable level for the caretaker to view and interact with the display screen 51. The stand 50 may allow for the variable height adjustment of the display screen 51, wherein the caregiver is given the capability to manipulate the height of the stand 50 through a plurality of telescoping members and a locking mechanism to lock in the desired height.

Located at the top of the stand 50 and preferably angled to the viewer is the display screen 51. The display screen 51 would preferably be touch screen sensitive, thus allowing the caregiver to input commands to operate the first vertical tilt platform 3 or the second vertical tilt platform 4, view the status and compliance of the wheelchair clasp system 34 and the plurality of straps, and input or display information associated with the weight scale. Alternative to or in addition to the touch screen capabilities, the display screen 51 may comprise a plurality of buttons. The plurality of buttons may be located along the perimeter of the display area. The plurality of buttons permits the input of commands such as activating the plurality of platform actuators 32 or the plurality of seat actuators 42, operating the ramp 35, operating the motion of the horizontal platform 2 in enhanced embodiments, etc.

In reference to FIG. 2-3, in some embodiments, the control system 5 may further comprise a plurality of pedals 52. Each of the plurality of pedals 52 is pivotally connected to the platform base 20. wherein the plurality of pedals 52 is accessible about the top surface of the platform base 20. Preferably, the plurality of pedals 52 is two pedals positioned adjacent to the stand 50, wherein each of the plurality of pedals 52 is closely clustered and parallel to one another. The plurality of pedals 52 would provide a primary means of inputting commands to the first vertical lift platform and the second vertical tilt platform 4 where the depression of a first pedal from the plurality of pedals 52 would raise the selected vertical tilt platform, and a second pedal from the plurality of pedals 52 would lower the selected vertical tilt platform. In some embodiments, the plurality of pedals 52 may be integrated with the frame 1 as opposed to the horizontal platform 2. In an alternate embodiment, the plurality of pedals 52 would be disparate of the horizontal platform 2 and capable of being connected by cable, wherein the plurality of pedals 52 will rest atop a remote box disparate of the frame 1 and the horizontal platform 2 but remain hooked into the display screen 51 and any actuation systems. Thus, the caretaker may aid, if desired, in assisting the individual into the standing position if the individual does not possess a walker to assist standing up or is enfeebled and incapable of standing upright without hand guided assistance for a non-descript duration.

In yet other embodiments, the control system 5 may comprise a microphone 54, wherein the microphone 54 is used to receive voice commands for operating the first vertical lift platform, the second vertical lift platform, the display screen 51, etc. In other embodiments, the control system 5 may comprise a transceiver 55, wherein the transceiver 55 is used to wirelessly connect the control system 5 to a remote electronic device, such as a smartphone. In this way, commands can be sent to the control system 5 via the remote electronic device and an associated software, such as a smartphone application. In yet other embodiments, the control system 5 may comprise a scanner 56. The scanner 56 is able to scan barcodes, radio frequency identification tags, or other unique identifiers in order to gather patient data, such as height and weight, and use the parameters to automatically adjust the height or tilt angles of the first vertical tilt platform 3 and the second vertical tilt platform 4.

In reference to FIG. 12, the control system 5 comprises a processing unit 53 that is able to receive, send, and process signals in order to control the operations of the display screen 51, the first vertical tilt platform 3, and the second vertical tilt platform 4. As such, the processing unit 53 may be electronically connected to one or more of the display screen 51, the plurality of pedals 52, the microphone 54, the transceiver 55, and the scanner 56. The processing unit 53 is configured to process inputs received via the display screen 51 (through either the touchscreen or the plurality of buttons) and perform the corresponding action. Further, the processing unit 53 is configured to output displays to the display screen 51. The processing unit 53 may also be configured to receive analog or digital inputs received via the plurality of pedals 52 and perform the corresponding action. The processing unit 53 may also be configured to process voice commands received via the microphone 54 and perform the corresponding action. Further, the processing unit 53 may be configured to send and receive signals via transceiver 55, such that commands can be input through the remote electronic device and outputs can be displayed on the remote computing device. The processing unit 53 may further be configured to process inputs received via the scanner 56.

Figure 9:
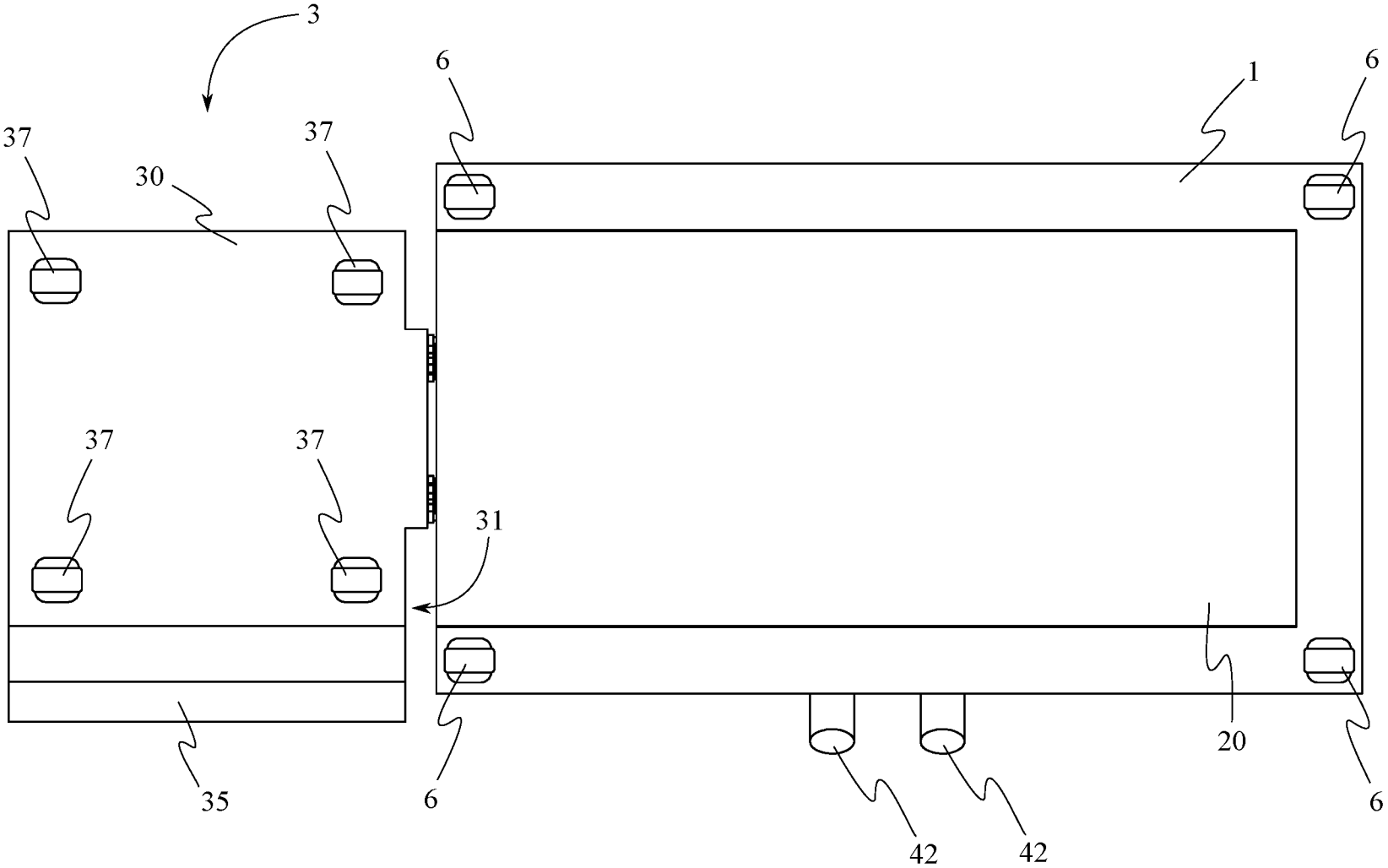
FIG. 9 is a bottom view of the assistive toileting apparatus of the present invention.

In reference to FIG. 9, the present invention may further comprise a plurality of frame wheels 6, wherein the plurality of frame wheels 6 is connected to the bottom of the frame 1. Through the plurality of frame wheels 6, the present invention may be readily wheeled around and subsequently locked in place upon reaching a user-desired destination. In one embodiment, the plurality of frame wheels 6 includes four wheels located on the bottom surface of the frame 1 at the four corners. The plurality of frame wheels 6 may be permitted to swivel 360 degrees through conventional bearing means and be fastened to the underside surface of the frame 1 through a means of fastening such as snap fits, conventional fasteners, and so on. Each of the plurality of frame wheels 6 may comprise a wheel lock that arrests the movement of the individual wheel both in rotation and swivel orientations, thus rendering the present invention stationary and grounded by weight when the wheel lock of each of the plurality of frame wheels 6 is engaged in the locked position.

Similarly and in further reference to FIG. 9, the first vertical tilt platform 3 may comprise a plurality of platform wheels 37. wherein the plurality of platform wheels 37 is connected to the bottom of the wheelchair support platform 30. The plurality of platform wheels 37 assists in moving the first vertical tilt platform 3 when the platform base 20 is extended from the frame 1. Furthermore, the plurality of platform wheels 37 supports the wheelchair support platform 30, removing stress from the joint between the first vertical tilt platform 3 and the platform base 20. The plurality of platform wheels 37 may be permitted to swivel 360 degrees through conventional bearing means and be fastened to the underside surface of the wheelchair support platform 30 through a means of fastening such as snap fits, conventional fasteners, and so on. Each of the plurality of platform wheels 37 may comprise a wheel lock that arrests the movement of the individual wheel both in rotation and swivel orientations, thus rendering the first vertical tilt platform 3 stationary and grounded by weight when the wheel lock of each of the plurality of platform wheels 37 is engaged in the locked position.

In reference to FIG. 1, the horizontal platform 2 may further comprise a horizontal slide bar 22 to assist the caregiver in extending the platform base 20 from the frame 1. As such, the horizontal slide bar 22 is adjacently connected to the platform base 20. More specifically, the horizontal slide bar 22 protrudes from the top surface of the platform base 20, and preferably protrudes from two points at a coincident height. The protrusions thereof would rise up and converge toward one another at a non-descript height in the form of an elevated handle. The horizontal slide bar 22 would permit the caretaker or extraneous second set of hands to operate and manually slide the platform base 20 from the frame 1 when the control system 5 notes that the system is compliant with regards to securing the wheelchair to the first vertical tilt platform 3. Otherwise the system will remain locked until satisfying the compliance status of the control system 5 and apparatus. In other embodiments the motor or other similar means may be provided to automatically extend the platform base 20 from the frame 1.

In some embodiments, a control panel may be integrated into the horizontal slide bar 22, wherein the control panel is electronically connected to the processing unit 53. The control panel provides a similar function to the plurality of buttons or the touchscreen capabilities of the display screen 51, wherein the caregiver can control the actuation of the first vertical tilt platform 3 or the second vertical tilt platform 4 from the horizontal slide bar 22. The control panel may be a touchscreen, one or more buttons, one or more switches, or any other suitable means of obtaining user input.

Although the invention has been explained in relation to its preferred embodiment, it is to be understood that many other possible modifications and variations can be made without departing from the spirit and scope of the invention as hereinafter claimed.

What is claimed is:

1. An assistive toileting apparatus comprises:

a horizontal platform being positioned within a frame;

the horizontal platform comprising a platform base;

the frame comprising an open end;

the horizontal platform being slidably engaged with the frame;

a first vertical tilt platform being terminally connected to the platform base, adjacent to the open end;

the first vertical tilt platform comprising a wheelchair support platform;

the wheelchair support platform being configured to incline at a first tilt angle in relation to the platform base;

a second vertical tilt platform comprising a commode seat and a seat lift-system;

the seat lift-system being integrated into the top of the platform base;

the commode seat being adjacently connected to the seat lift-system opposite the platform base;

the seat lift-system being configured to incline the commode seat at a second tilt angle in relation to the platform base; and a control system being operably coupled to the first vertical tilt platform and the second vertical tilt platform.

2. The assistive toileting apparatus as claimed in claim 1 comprises:

the horizontal platform further comprising a plurality of rail casters;

the frame further comprising a plurality of rail cavities; and each of the plurality of rail casters being positioned within one of the plurality of rail cavities.

3. The assistive toileting apparatus as claimed in claim 1 comprises:

the horizontal platform further comprising a plurality of rail casters;

the plurality of rail casters being laterally connected to the platform base; and the plurality of rail casters being distributed along the platform base.

4. The assistive toileting apparatus as claimed in claim 1 comprises:

the first vertical tilt platform further comprising a ramp;

the wheelchair support platform comprising a loading end; and the ramp being hingedly connected to the wheelchair support platform about the loading end.

5. The assistive toileting apparatus as claimed in claim 1 comprises:

the first vertical tilt platform further comprising a plurality of wheel stops;

the wheelchair support platform comprising a loading end; and the plurality of wheel stops being adjacently connected to the wheelchair support platform opposite the loading end.

6. The assistive toileting apparatus as claimed in claim 1, wherein the wheelchair support platform is a weight scale.

7. The assistive toileting apparatus as claimed in claim 1 comprises:

the first vertical tilt platform further comprising a wheelchair clasp system; and the wheelchair clasp system being pivotally connected to the wheelchair support platform.

8. The assistive toileting apparatus as claimed in claim 7 comprises:

the wheelchair clasp system being centrally positioned about the wheelchair support platform.

9. The assistive toileting apparatus as claimed in claim 1 comprises:

the first vertical tilt platform further comprising a plurality of platform actuators; and the plurality of platform actuators being configured to incline the wheelchair support platform at the first tilt angle.

10. The assistive toileting apparatus as claimed in claim 1 comprises:

the seat lift-system comprising a plurality of seat actuators and a plurality of seat linkages;

the commode seat being adjacently connected to the plurality of seat linkages; and the plurality of seat actuators being operably coupled to the plurality of seat linkages in order to incline the commode seat at the second tilt angle.

11. The assistive toileting apparatus as claimed in claim 1 comprises:

the control system comprising a stand and a display screen;

the stand being adjacently connected to the platform base; and the display screen being terminally connected to the stand opposite the platform base.

12. The assistive toileting apparatus as claimed in claim 1 comprises:

the control system comprising a display screen and a processing unit;

the display screen being electronically connected to the processing unit; and the processing unit being configured to process inputs received via the display screen.

13. The assistive toileting apparatus as claimed in claim 1 comprises:

the control system comprising a microphone and a processing unit;

the microphone being electronically connected to the processing unit; and the processing unit being configured to process voice commands received via the microphone.

14. The assistive toileting apparatus as claimed in claim 1 comprises:

the control system comprising a transceiver and a processing unit;

the transceiver being electronically connected to the processing unit; and the processing unit being configured to send and receive signals via the transceiver.

15. The assistive toileting apparatus as claimed in claim 1 comprises:

the control system comprising a plurality of pedals; and each of the plurality of pedals being pivotally connected to the platform base.

16. The assistive toileting apparatus as claimed in claim 1 comprises:

the control system comprising a plurality of pedals and a processing unit;

the plurality of pedals being electronically connected to the processing unit; and the processing unit being configured to process inputs received via the plurality of pedals.

17. The assistive toileting apparatus as claimed in claim 1 comprises:

the control system comprising a scanner and a processing unit;

the scanner being electronically connected to the processing unit; and the processing unit being configured to process inputs received via the scanner.

18. The assistive toileting apparatus as claimed in claim 1 comprises:

the horizontal platform further comprising a horizontal slide bar; and the horizontal slide bar being adjacently connected to the platform base.

19. The assistive toileting apparatus as claimed in claim 1 comprises:

a plurality of frame wheels; and the plurality of frame wheels being connected to the bottom of the frame.

20. The assistive toileting apparatus as claimed in claim 1 comprises:

the first vertical platform further comprising a plurality of platform wheels; and the plurality of platform wheels being connected to the bottom of the wheelchair support platform.

* * * * *